United States Patent [19]

Law et al.

[11] Patent Number: 4,709,743

[45] Date of Patent: Dec. 1, 1987

[54] CASTING METAL STRIP

[75] Inventors: Anthony G. Law, Lichfield; Michael J. Fleetwood, Bewdley, both of England

[73] Assignees: Inco Enginered Products Ltd.; The General Electric Company plc, both of England

[21] Appl. No.: 3,625

[22] Filed: Jan. 15, 1987

[30] Foreign Application Priority Data

Jan. 28, 1986 [GB] United Kingdom ..... 8602001

[51] Int. Cl.[4] ..... B22D 11/06; B22D 11/10; B22D 39/00

[52] U.S. Cl. ..... 164/463; 164/423; 164/337; 164/437; 164/488; 222/599; 222/600

[58] Field of Search ..... 164/463, 423, 337, 437, 164/488; 222/597-600

[56] References Cited

U.S. PATENT DOCUMENTS 4,433,715 2/1984 Smith ..... 164/423

FOREIGN PATENT DOCUMENTS 1,115,395 5/1968 United Kingdom .

*Primary Examiner*—Kuang Y. Lin

*Attorney, Agent, or Firm*—Larson and Taylor

[57] ABSTRACT

In casting thin metal strip or foil by dynamic casting in which molten metal is teemed from a crucible 13 onto a moving belt or wheel, the invention provides an outlet orifice control assembly arranged to define a slot of controlled width through which the metal flows from the crucible outlet 20. The assembly comprises opposed shut-off plates 28,29 extending between edge strips 26,27, and underlying these are opposed slot plates 32,33 extending between second edge strips 30,31 with opposed support strips 34,35 extending beneath the strips 30,31 and supporting the edges of the slot plates 32,33. The sets of plates are aligned and arranged so that one plate 29 and 33 is movable relative to the other respective plate 28 and 32 between closed and open positions for controlled flow of metal through a sized slot defined between the slot plates 32,33. The assembly slot of the simple form of plates is supported in a plate housing with suitable drive connections through holes 47,48 respectively in plates 29,33 to enable controlled adjustment of the width of the slot while obviating effects of chilling and thermal stress in use, and while providing advantages in manufacture and installation. Various detail features of the casting process and use of the outlet orifice control assembly are described.

17 Claims, 4 Drawing Figures

CASTING METAL STRIP

DESCRIPTION

This invention concerns improvements in casting thin metal strip or foil. The invention relates particularly to the process and apparatus for casting molten metal on a moving casting surface to produce thin metallic strip or foil, such process and apparatus often being referred to as "wheel or belt casting".

In "wheel casting", the molten metal is teemed onto the surface of a rotating wheel, and in "belt casting", the molten metal is teemed onto the surface of an advancing belt which is usually continuous and advancing linearly relative to the stream of metal. In both types of casting, the dynamic movement of the casting surface is essential in the production of the strip or foil, and the moving surface acts as a quench for the molten metal. For convenience herein, the term "dynamic casting" is used where the context admits to mean both the "wheel casting" and "belt casting" processes and apparatus.

One of the critical factors in such dynamic casting for producing thin strip or foil is the design and control of the outlet from the crucible through which the molten metal is teemed onto the moving casting surface. Although there are many factors to be accommodated in the process and apparatus, such as the melt size, head of molten metal, temperature and viscosity, these are associated either directly or indirectly with the casting performance dictated by the design and control of the outlet.

In known apparatus and processes for dynamic casting of thin metallic strips, it is conventional to provide a tundish that is mounted adjacent to the casting surface with the tundish having an uncontrolled opening through which molten metal poured into the tundish is discharged onto the advancing casting surface. Various complex designs of tundish have been proposed but these are directed to the construction of the tundish for the parameters relating to holding the molten metal and discharging it from the tundish in close proximity to the casting surface through the opening which is usually in the form of a narrow slot.

Such tundish teeming of the molten metal onto the casting surface creates many problems including the lack of control during teeming such as if the opening is obstructed by chilling or included debris, or if the tundish opening becomes damaged or is subjected to wear. In addition, there is no provision to interrupt teeming once commenced nor is it possible to control or regulate the size of the opening during the teeming to accommodate variable factors like the decreasing head of molten metal within the tundish.

Accordingly, considerable problems arise in the known apparatus and process because of the inherent lack of control when teeming from the tundish and the limitations of such apparatus and process.

It is an object of this invention to provide an improved apparatus for dynamic casting (as aforedefined) with a special form of outlet for controlling the teeming of the molten metal.

It is a further object of this invention to provide improvements in dynamic casting (as aforedefined) wherein the flow of molten metal can be controlled.

According to one aspect of this invention we provide apparatus for dynamic casting (as aforedefined) of metallic strip or foil wherein a crucible for molten metal to be poured on the moving casting surface has a bottom outlet and an outlet orifice control assembly is mounted to underlie said crucible outlet, the outlet orifice control assembly comprising two opposed shut-off plates mounted for controlled relative movement between closed and open positions to control flow of molten metal from said crucible outlet, and the outlet orifice control assembly further comprising two opposed slot plates underlying said shut-off plates and mounted for controlled relative movement between closed and open positions to define a slot through which the molten metal is discharged onto the moving casting surface.

By this invented apparatus, there is provided an outlet control assembly which can control the flow of metal from the crucible outlet as well as providing a slot of which the width can be adjusted and controlled in accordance with desired parameters.

The component parts of the outlet control assembly can be of simple geometry and thus easy to manufacture. The use of simple shapes for the parts obviates thermal stresses in the parts and the assembly during use.

Preferably, the crucible is provided with means for heating a charge in the crucible. By such an arrangement, the chill effect as commonly found can be obviated.

Conveniently, the crucible and outlet control assembly may be supported on a plate assembly mounted for movement relative to the moving casting surface. This movement may be controlled to vary the spacing between the outlet slot of the control assembly and the casting surface.

According to another aspect of this invention, we provide a dynamic casting process (as aforedefined) for producing thin metallic strips or foils wherein the charge is melted in a crucible and the flow of molten metal from a bottom opening of the crucible onto the casting surface is controlled by two opposed shut-off plates that are movable to open a passageway for molten metal, and two opposed slot plates mounted below the shut-off plates are relatively movable to define an outlet slot for controlled discharge of the molten metal onto the casting surface..

By this invented process, the rate of discharge of the molten metal discharged onto the casting surface can be controlled and regulated. In the process, the flow of molten metal is regulated by the size of the outlet slot which can be controlled to regulate the flow and/or quantity of molten metal discharged. This advantage is lmportant when processing molten metals having comparatively low surface tension or low viscosity, such as micro-crystalline alloys. In addition, the required degree of melt super-heat can be obtained prior to opening the slot plates to obviate "chilling" or "freezing-up" at the outlet slot.

The shut-off plates may be left in the "open" position during melting or heating of the metal so that the slot-plates are in intimate contact with the molten metal when at temperature for teeming to reduce chilling effects. The shut-off plates may be used in the process to control the flow of metal from the crucible or to close the outlet from the crucible. The shut-off plates may be used as a fail-safe control in the event of failure or damage to the slot plates, and the arrangement of the shut-off plates and the slot plates enables all possible control arrangements to be available to the melt operator depending on the requirements and characteristics of the particular metal and melt and other factors.

In the invented apparatus and process, the system of plates which define the flow path and the slot through which the metal is discharged, the width of the slot can be closely controlled to the degree required for producing thin strips or foil of metal by dynamic casting. Such an arrangement is different to the known use of sliding gate valves as used for controlling high rate teeming of metal from a crucible or from a tundish where critical control of the size of the orifice is not required to disperse the molten metal into an accurate thin wide stream.

Preferably, both the shut off plates and the slot plates are located by respective edge strips and the slot plates are supported by support strips. Thus, the outlet control assembly comprises simple forms of plates that are arranged for inter-engaging support and relative movement to define the narrow slot required as well as enabling high rates of heat transfer from the metal whilst accommodating adjustment selected in accordance with the criteria for the fluid dynamics of the molten metal.

In a preferred arrangement according to this invention, the narrow slot is defined by the two opposed slot plates and the associated opposed edge plates so that the boundary of the slot through which the metal is directed is constituted by four plates.

Each plate is of refractory material which may be made in the form of strips that can be produced and assembled accurately as well as enabling replacement in a simple manner. The use of strips of refractory material also enables thermal stress factors to be obviated, for instance as arise in certain orifice arrangements where a refractory block has to be made or machined or ground to the required size and shape including small radius sections that induce low resistance to thermal stress.

It is also preferred that the shut-off plates with their respective opposed edge plates are in the form of refractory strips similar to those used for the slot plates and their associated edge strips. In addition, the outlet control orifice may include further similar strips provided to support the slot plates. Thus the whole assembly for the outlet control orifice may comprise a simple assembly of refractory strips that are arranged to define the narrow slot as well as controlling the flow of the molten metal.

Other features of this invention and the merits thereof will be understood from the description following hereafter.

The invention as applied to a dynamic casting process and apparatus will now be described with reference to the accompanying drawings wherein.

Figure 1:
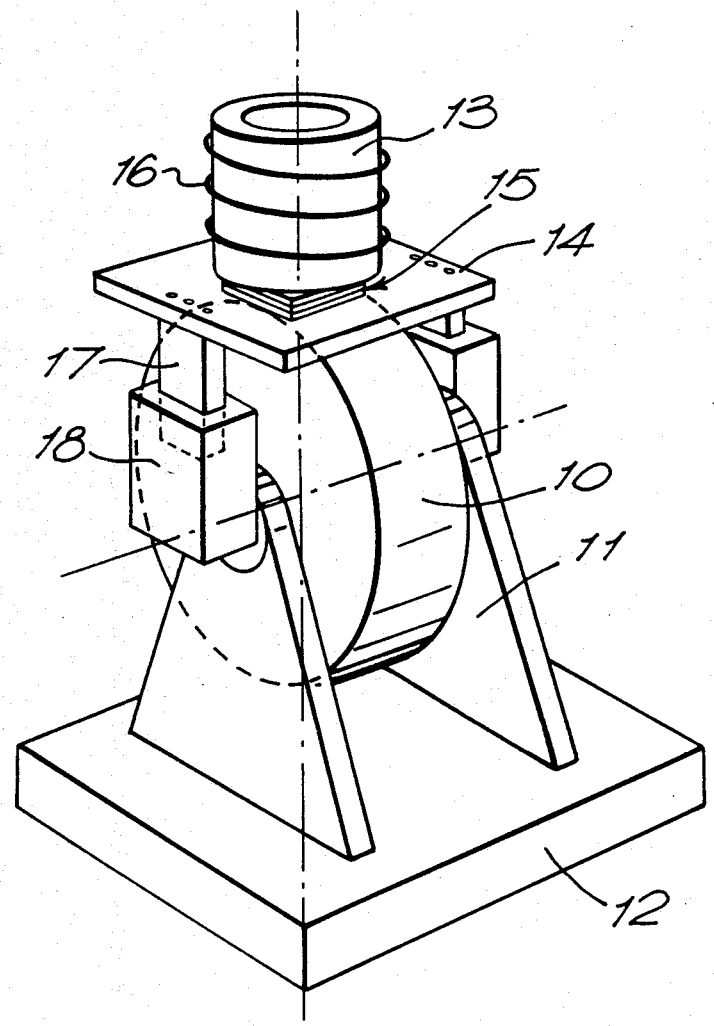
FIG. 1 is a schematic view of a wheel casting apparatus embodying the invention.

The wheel casting apparatus is schematically shown in FIG. 1 and comprises a casting wheel 10 mounted on side bearers 11 supported on a plinth 12. The wheel 10 is driven by any suitable motor and drive transmission (not shown) to rotate the wheel with the peripheral speed of the casting surface being between 5 to 20 metres per second. In known manner, the wheel 10 may be internally cooled and the casting surface may be of copper or other heat conductive material. The diameter of the wheel 10 may be between 50 to 2000 mm., and the peripheral width may be between 10 to 200 mm.

A crucible 13 is supported above the wheel 10 by a plate assembly 14 mounting a control orifice assembly 15. A heating coil 16 surrounds the crucible 13 for heating and/or melting a charge within the crucible. The plate assembly 14 is supported at each side on slides 17 which are arranged to be precisely adjusted and controlled by suitable means indicated at 18, such as a stepping motor and drive lead screw, in order to adjust and control the position of the plate assembly 14 with the crucible 13 relative to the casting surface.

Figure 2:
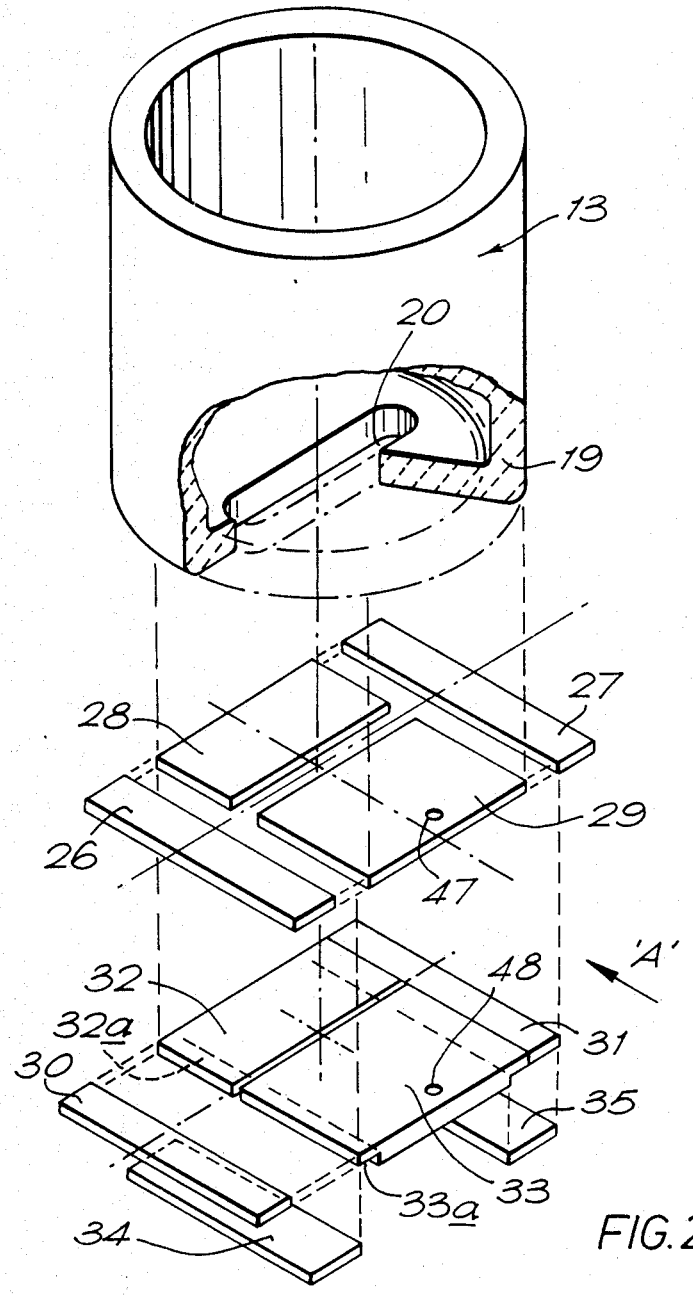
FIG. 2 is a schematic detail view depicting the crucible and general arrangement of the main component parts of the outlet orifice control assembly.
Figure 3:
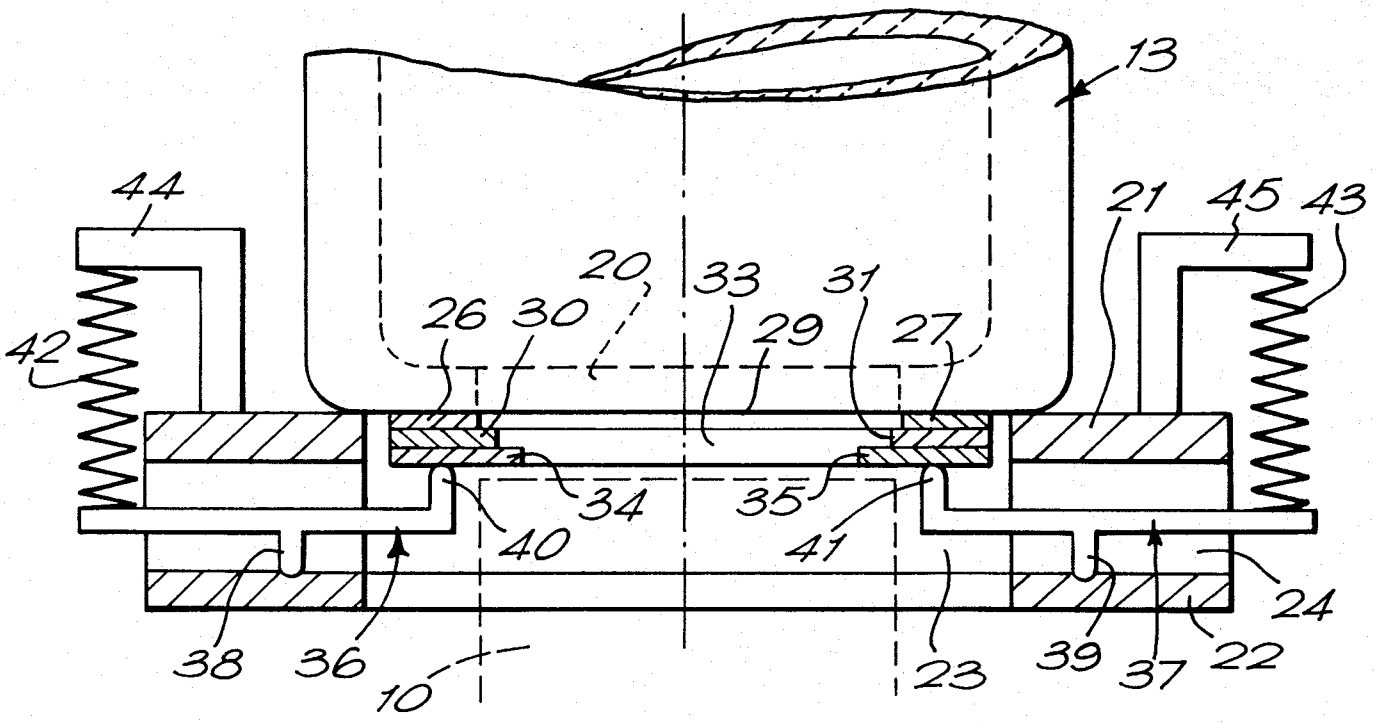
FIG. 3 is a part sectional detail view in the direction A of FIG. 2 and showing the outlet orifice assembly.

With reference to FIGS. 2 and 3, the crucible 13 is of conventional pot form and would be made of a high refractory material. The base 19 of the crucible is formed with an elongate outlet slot 20. The rim of the base of the crucible rests on the plate assembly 14 which comprises upper and lower plates 21,22 which are secured together in spaced relationship by suitable bolts, studs and spacers (not shown) which have a central aperture 23 of substantially rectangular shape in which the control orifice assembly 15 is supported. The plate assembly 14 provides a housing for operating means of the control orifice assembly which extend within the housing, and one or both of the plates may mount associated power devices and links or brackets. Refractory packers and/or insulation may be provided between the plates remote from the central aperture.

The control orifice assembly 15 is mounted in the central aperture 23 and is substantially rectangular in plan view and comprises opposed first edge strips 26,27 between which two opposed shut-off plates 28,29 extend with the first edge strips engaging the underside of the base of the crucible. Opposed second edge strips 30,31 extend beneath respective first edge strips 26,27 and two opposed slot plates 32,33 extend therebetween and support the overlying shut-off plates 28,29. Opposed support strips 34,35 extend beneath the second edge strips 30,31 and provide support for the edges of the slot plates 32,33.

The assembly 15 is supported and maintained in engagement with the base of the crucible by opposed pairs of levers 36,37 mounted and extending within the plate housing 24. Each lever 36,37 is supported on a fulcrum 38,39 within the plate housing and one arm of the lever terminates in a lug 40,41 engaging the underside of the respective support strip 34,35. The other arm of each lever is subjected to the force of a spring 42,43 of which one end is connected to the lever arm 36,37 and the other end is connected to a respective bracket 44,45 mounted on the upper plate 21 of the plate assembly 14.

As best shown in FIG. 2, the adjacent inner edge iaces of the respective shut-off plates 28,29 and slot plates 32,33 are aligned and in register with each other as well as the outlet slot 20 of the crucible 13. The alignment of the outlet slot 20 of the crucible is transverse to the direction of advancement of the casting surface and the upper peripheral marginal portion of the casting wheel 10 is received closely within the aperture 23 in the plate assembly and is closely adjacent to the plane of the underside of the slot plates 32,33. The spacing between the casting surface and the slot plates is preferably between 0.02 mm and 30.00 mm when the molten metal is being cast, and as previously mentioned this spacing is regulated by the controlled displacement of the plate assembly on the supporting slides (FIG. 1).

Figure 4:
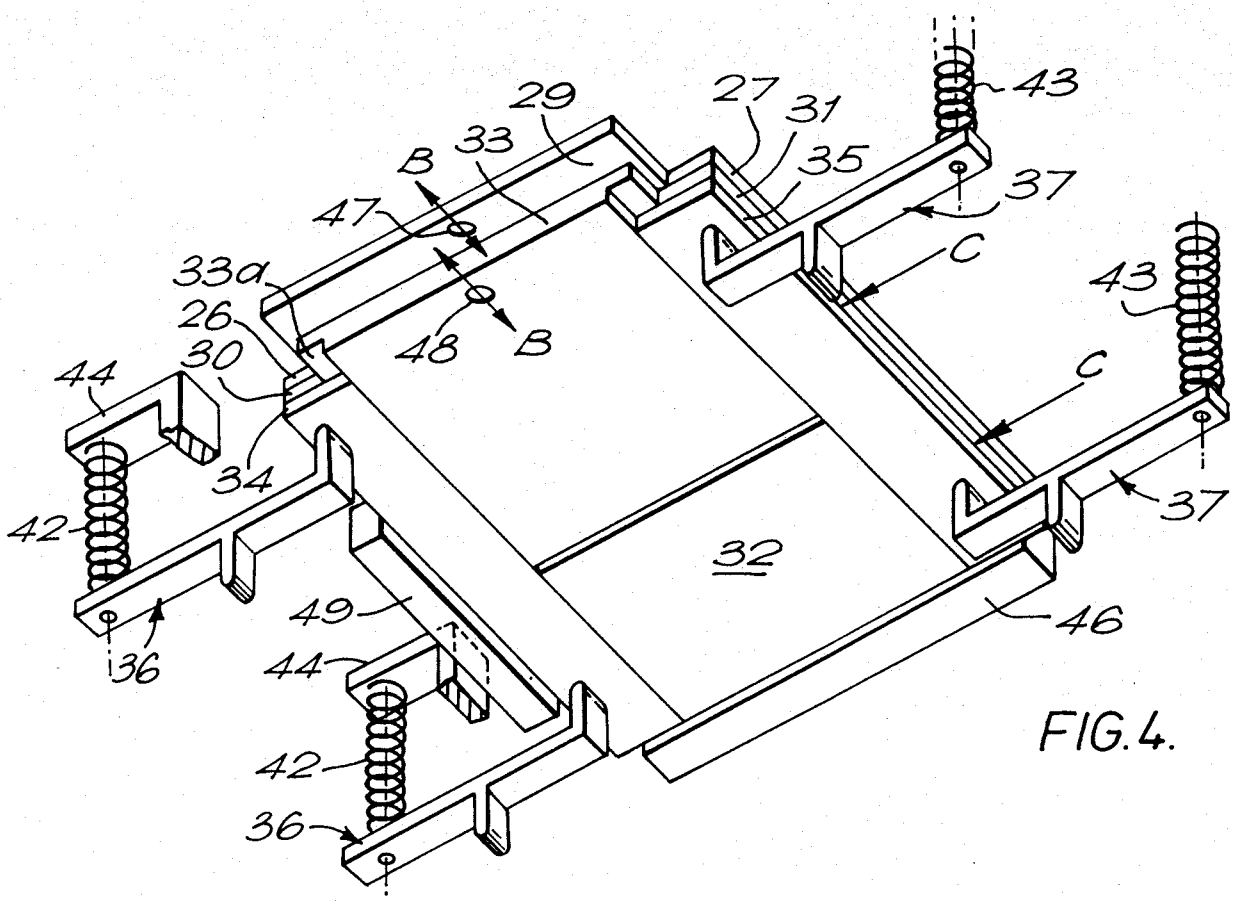
FIG. 4 is a schematic underneath view of the outlet orifice control assembly.

With reference also to FIG. 4, the orifice control assembly includes an abutment block 46 which is fixed or secured relative to the plate assembly. The block 46 provides a rigid abutment and support for one end of each of the first and second edge strips 26,27 and 30,31 and of the support strips 34,35.

Additionally, the one shut-off plate 28 and the one slot plate 32 adjacent to the block are supported against the block and are each fixed or secured to prevent movement relative to the block and the edge and support strips. The other shut-off plate 29 and the other slot plate 33 are each arranged and adapted to be movable with respect to their respective complementary plate so as to be moved between "closed" and "open" positions.

Each movable shut-off plate 29 and slot plate 33 may be coupled by a drive pin extending through a hole 47,48 in the respective plate to a pneumatic cylinder or screw device (not shown) for controlled operating actuation in the direction of the arrows B shown in FIG. 4.

The movable shut-off plate 29 is guided for such movement by the engagement of the side faces with the first edge strips 26,27. Each slot plate 32,33 has a recess **32*a*,33*a* along the opposed side edges and the outer side face of each slot plate engages the second edge strips 30,31. The recess face 32*a*,33*a* on each side of the slot plates 32,33 engages the respective face of the support strips 34,35 and the ledge wall of each recess engages the respective side edge of the support strips so that this engagement guides the movable slot plate 33 when displaced relative to the fixed slot plate 32**.

A second abutment block 49 extends along one side of the assembled edge strips and support strip. This block 49 provides a rigid abutment to prevent lateral movement of the assembly. The block may be secured in the housing and/or to the plate assembly.

On the side of the assembly opposed to the rigid side block 49, a spring or other force as indicated by the arrows C is applied to the side faces of the assembled edge strips 27,31 and support strip 35 to maintain the assembly together whilst enabling the controlled relative movement of the movable shut-off and slot plates.

Each of the component parts of the orifice control assembly is made of a suitable material for high temperature use, and the blocks and/or plates and strips may be of refractory, ceramic or special metal.

In the preferred use of the apparatus including the orifice control assembly, prior to casting the movable shut-off plates are maintained in the "open" position, and the slot plates are held in in the "closed" position. The crucible is loaded with the charge and this is heated and melted. During melting, the charge will initially form a skull over the bottom closed slot plates. The orifice control assembly will be heated by thermal transfer from the crucible and the heated charge so that the slot plates including their abutting edges will be brought to thermal equilibrium with the molten charge.

The slot plates provide the controlled outlet orifice which is initially "closed" and which may be opened on controlled movement of the movable plate when casting is to commence.

As will now be appreciated, the outlet orifice for teeming the molten metal onto the casting surface is provided by the relative movement of the slot plates with the movable slot plate being moved by a controlled distance to a selected position. Thus the width of the orifice slot can be selected as required for the critical conditions for the particular melt etc.

Depending on the particular use and application of the orifice control assembly, the shut-off plates can provide a valve intermediate the crucible and the outlet orifice to control flow to and through the outlet orifice independently of the size of the slot in the base of the crucible. Furthermore, the shut-off plates can provide a closure for the crucible outlet as might be required.

In this preferred embodiment, the relative movement of the respective shut-off and slot plates is achieved by providing one fixed plate and one movable plate. However, it is envisaged that each shut-off plate and/or each slot plate could be arranged for movement towards and away from each other.

In addition, as both movable plates of the shut-off plates and the slot plates can be controlled for relative movement, it is possible to displace each plate greater than a working width and thereby to provide a dumping facility whereby the melt in the crucible may be discharged quickly, for instance in an emergency or at the end of a casting procedure.

The spacing of the outlet orifice relative to the casting surface may be adjusted or selected and controlled during the casting operation by a motor adjustment of the slides supporting the plate assembly carrying the crucible and outlet orifice assembly.

The outlet orifice assembly is comprised of simple flat plates which can be replaced or dressed as required between each casting operation. The simple shape of the plates and the assembly obviates risks of thermal stressing arising from the high thermal gradients in use and during casting.

In the exemplary embodiment shown in the accompanying drawings, the inner edge faces of the sets of shut-off and slot plates are each shown as of square edge form. However, it is envisaged that the inner edge faces may be curved or configured to avoid turbulence in the molten metal flow, for instance as might be caused by sharp angular leading edges projecting into the liquid stream. The edge faces may have a leading curved or profiled form to avoid such turbulence, or the edge faces may have complementary inclined faces. Additionally, some design configuration to avoid sharp angular edges may be desirable to further obviate thermal stressing of the plates.

In the apparatus, any suitable electric or electronic means for controlling the movement of the plates of the outlet orifice assembly and the plate assembly may be provided.

The invented apparatus and process as described depicts a top teeming arrangement with the crucible being vertically held over the top of the wheel. However, this is not essential as the crucible could be mounted to either side of the wheel for up-hill or down-hill casting provided that the supports and plate assembly are configured for the angular projection of the wheel rim and clearances required.

The invented apparatus and process as described can be applied to the dynamic casting process using a continuous belt which advances beneath the crucible supported on the plate assembly which supports the outlet orifice assembly. In known manner the molten metal is teemed onto the advancing surface of the belt and is stripped therefrom at a position remote from the crucible and where the metal has solidified following quenching on the belt surface. The actual construction and assembly of such belt arrangement is not essential to this invention.

We claim:

1. Apparatus for dynamic casting of metallic strip or foil wherein a crucible for molten metal to be poured on a moving casting surface has a bottom outlet, an outlet orifice control assembly is mounted to underlie said crucible outlet, said outlet orifice control assembly comprising two opposed shut-off plates mounted for controlled relative movement between closed and open positions to control flow of molten metal from said crucible outlet, and said outlet orifice control assembly further comprising two opposed slot plates underlying said shut-off plates and mounted for controlled relative movement between closed and open positions to define a slot through which the molten metal is discharged onto the moving casting surface.

2. Apparatus according to claim 1 wherein said crucible is provided with means for heating a charge in the crucible.

3. Apparatus according to claim 2 wherein said crucible and outlet orifice control assembly are mounted on a plate assembly mounted for movement relative to said moving casting surface.

4. Apparatus according to claim 3 wherein said outlet orifice control assembly comprises opposed edge strips between which said two opposed shut-off plates extend with said opposed edge strips engaging the underside base of said crucible.

5. Apparatus according to claim 4 wherein opposed second edge strips extend respectively beneath said first-mentioned edge strips and said two opposed slot plates extend between said second edge strips underlying and supporting said opposed shut-off plates.

6. Apparatus according to claim 5 wherein opposed support strips extend beneath said second edge strips and support the edges of said slot plates.

7. Apparatus according to claim 6 wherein the adjacent inner edge faces of said respective shut-off and slot plates are aligned and in register with each other and aligned with respect to said crucible outlet which is also in the form of a slot of which the major axis extends transverse to the direction of advancement of said moving casting surface.

8. Apparatus according to claim 3 wherein plate assembly comprises upper and lower plates which are secured together in spaced relationship defining a central aperture in which said outlet orifice control assembly is supported.

9. Apparatus according to claim 8 wherein said plate assembly provides a housing for operating means coupled to the movable parts of said outlet orifice control assembly.

10. Apparatus according to claim 9 wherein said plate assembly includes an abutment block with one of said two shut-off plates and one of said two slot plates being supported against said block against movement relative to the block whilst the other ones respectively of said shut-off and slot plates are mounted for movement relative to said abutment block between closed and open positions to function respectively as valves to control the flow of molten metal from said crucible.

11. Apparatus according to claim 10 wherein said movable plates are mounted for movement in substantially the same sense between said closed and open positions.

12. A dynamic casting process for producing thin metallic strip or foil comprising the steps of:

melting a charge in a crucible having a bottom outlet;

providing a moving casting surface;

controlling the flow of molten metal from the bottom outlet onto the moving casting surface by relatively moving two opposed shut-off plates to open a passageway for molten metal; and relatively moving two opposed slot plates mounted below the shut-off plates to define an outlet slot.

13. The process according to claim 12 and further comprising the step of advancing the moving casting surface at a speed of between 5 to 20 meters per second.

14. The process according to claim 13 and further comprising the step of forming the moving casting surface by a driven wheel having a diameter of between 50 to 2000 mm. and a peripheral width of between 10 to 200 mm.

15. The process according to claim 12 and further comprising the steps of closing the crucible bottom opening by said slot plates during melting or holding of the molten metal and maintaining said shut-off plates open so that the molten metal is in contact with said slot plates.

16. The process according to claim 15 and further comprising the step of controlling an opening movement of said slot plates to control a rate of teeming of the molten metal.

17. The process according to claim 16 wherein the rate of teeming of the molten metal is further controlled by the further step of controlling the movement of said shut-off plates.

* * * * *